US005973933A

United States Patent [19]

Meyer

[11] Patent Number: 5,973,933

[45] Date of Patent: Oct. 26, 1999

[54] INTERCONNECTION ARRANGEMENT FOR DISTRIBUTION OF ELECTRICAL SIGNAL

[75] Inventor: Charles S. Meyer, Nevada City, Calif.

[73] Assignee: NVision, Inc., Grass Valley, Calif.

[21] Appl. No.: 09/074,637

[22] Filed: May 7, 1998

[51] Int. Cl.[6] ..... H01R 9/09

[52] U.S. Cl. ..... 361/788; 439/61

[58] Field of Search ..... 439/61; 361/788

[56] References Cited

U.S. PATENT DOCUMENTS

| | | | |
|---|---|---|---|
| 3,605,061 | 9/1971 | Martin | 439/61 |
| 4,333,696 | 6/1982 | O'Neil et al. | 439/61 |
| 4,574,332 | 3/1986 | Calabro | 361/788 |
| 5,006,961 | 4/1991 | Monico | 361/788 |

*Primary Examiner*—Neil Abrams
*Assistant Examiner*—J. F. Duverne
*Attorney, Agent, or Firm*—Smith-Hill and Bedell

[57] ABSTRACT

An interconnection arrangement includes an input card, a signal distribution board having first and second opposite main faces, and an input connector having first and second releasably engageable parts with the first part of the input connector attached to the signal distribution board at the first main face thereof and the second part of the input connector attached to the input card. A bus driver circuit is mounted on the input card and has a signal input terminal for receiving an input signal to be distributed. The bus driver circuit includes first and second bus drivers. The first and second bus drivers each have an input connected to the signal input terminal of the bus driver circuit and they have separate respective outputs connected to first and second pins respectively of the second part of the input connector. A first signal distribution bus on the signal distribution board extends from a first pin of the first part of the input connector in a first direction and a second signal distribution bus on the signal distribution board extends from a second pin of the first part of the input connector in a second direction, opposite the first direction. The first and second pins of the first part of the input connector are connected to the first and second pins respectively of the second part of the input connector when the first and second parts of the input connector are engaged.

12 Claims, 5 Drawing Sheets

INTERCONNECTION ARRANGEMENT FOR DISTRIBUTION OF ELECTRICAL SIGNAL

BACKGROUND OF THE INVENTION

This invention relates to an interconnection arrangement for distributing electrical signals.

In many types of electronic equipment, it is necessary to distribute electrical signals to numerous receiving devices mounted on respective receiving cards.

FIG. 1 illustrates four electrical signal sources 2, each providing a high frequency electrical signal having two distinct logic levels. FIG. 1 also illustrates multiple receiving devices 4 and an interconnection arrangement 6. The purpose of the interconnection arrangement 6 is to make each of the signals provided by the signal sources 2 available to each of the receiving devices 4. As shown in FIG. 1, this may be accomplished by use of signal buses which are connected to the outputs of the signal devices and are selectively tapped by the receiving devices.

If the signal buses are linear, the length of each signal bus will depend on the number of receiving devices, because each receiving device takes up a finite space and each additional receiving device requires an additional amount of bus length. Thus, as the number of receiving devices increases, the length of the signal buses increases. As the length of the buses increases, signal degradation by transmission over the buses may render the interconnection arrangement unsuitable for high frequency digital signals.

SUMMARY OF THE INVENTION

According to a first aspect of the present invention there is provided an interconnection arrangement comprising an input card, a signal distribution board having first and second opposite main faces, first and second sets of signal receiving cards, a plurality of connectors, the plurality of connectors being composed of an input connector, a first set of distribution connectors and a second set of distribution connectors, each of said connectors having first and second releasably engageable parts with the first part of the input connector being attached to the signal distribution board at the first main face thereof, the first part of each connector of the first set of distribution connectors being attached to the signal distribution board at the first main face thereof and spaced from the first part of the input connector in a first direction, and the first part of each connector of the second set of distribution connectors being attached to the signal distribution board at the first main face thereof and spaced from the first part of the input connector in a second direction, which is opposite said first direction, the second part of the input connector being attached to the input card, the second parts of the first set of distribution connectors being attached to the first set of signal receiving cards respectively, and the second parts of the second set of distribution connectors being attached to the second set of signal receiving cards respectively, a bus driver circuit mounted on the input card, the bus driver circuit having a signal input terminal for receiving an input signal to be distributed and including first and second bus drivers each having an input connected to said signal input terminal and having separate respective outputs connected to first and second pins respectively of the second part of the input connector, a first signal distribution bus on the signal distribution board extending from a first pin of the first part of the input connector in said first direction and connected to pins of the first parts of the first set of distribution connectors, a second signal distribution bus on the signal distribution board extending from a second pin of the first part of the input connector in said second direction and connected to pins of the first parts of the second set of distribution connectors, and wherein the first and second pins of the first part of the input connector are connected to the first and second pins respectively of the second part of the input connector when the first and second parts of the input connector are engaged.

According to a second aspect of the present invention there is provided an interconnection arrangement comprising first and second input cards, a signal distribution board having first and second opposite main faces, first and second sets of signal receiving cards, a plurality of connectors, the plurality of connectors being composed of first and second input connectors, a first set of distribution connectors and a second set of distribution connectors, each of said connectors having first and second releasably engageable parts with the first part of each input connector being attached to the signal distribution board at the first main face thereof, the first part of each connector of the first set of distribution connectors being attached to the signal distribution board at the first main face thereof and spaced from the first parts of the input connectors in a first direction, and the first part of each connector of the second set of distribution connectors being attached to the signal distribution board at the first main face thereof and spaced from the first parts of the input connectors in a second direction, which is opposite said first direction, the second parts of the first and second input connectors being attached to the first and second input cards respectively, the second parts of the first set of distribution connectors being attached to the first set of signal receiving cards respectively, and the second parts of the second set of distribution connectors being attached to the second set of signal receiving cards respectively, and first and second bus driver circuits mounted on the first and second input cards respectively, the bus driver circuit mounted on each input card having a signal input terminal for receiving an input signal to be distributed and including first and second bus drivers each having an input connected to said signal input terminal and having separate respective outputs connected to first and second pins respectively of the second part of the input connector attached to the input card, wherein the first and second pins of the first part of the first input connector are connected to the first and second pins respectively of the second part of the first input connector when the first and second parts of the first input connector are engaged and the first and second pins of the first part of the second input connector are connected to the first and second pins respectively of the second part of the second input connector when the first and second parts of the second input connector are engaged.

According to a third aspect of the present invention there is provided an interconnection arrangement comprising an input card, a signal distribution board having first and second opposite main faces, an input connector having first and second releasably engageable parts with the first part of the input connector attached to the signal distribution board at the first main face thereof and the second part of the input connector attached to the input card, a bus driver circuit mounted on the input card, the bus driver circuit having a signal input terminal for receiving an input signal to be distributed and including first and second bus drivers each having an input connected to said signal input terminal and having separate respective outputs connected to first and second pins respectively of the second part of the input connector, a first signal distribution bus on the signal distribution board extending from a first pin of the first part of the input connector in a first direction, and a second signal distribution bus on the signal distribution board extending from a second pin of the first part of the input connector in a second direction, opposite said first direction, and wherein the first and second pins of the first part of the input connector are connected to the first and second pins respectively of the second part of the input connector when the first and second parts of the input connector are engaged.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

FIGS. 2–9 illustrate an interconnection arrangement for distributing electrical signals to multiple receiving devices. The interconnection arrangement comprises a signal distribution board 10 which is vertically disposed and carries an input connector receptacle 14A positioned between a first receiving connector receptacle 18A and a second receiving connector receptacle 22A.

The signal distribution board is a multilayer board having five conductive layers. Layers 1, 3 and 5 are essentially continuous and are linked by vias (not shown). At least one of layers 1, 3 and 5 of the signal distribution board is in direct electrically conductive contact with a ground terminal, whereby layers 1, 3 and 5 of the signal distribution board are held at a firm ground potential and form respective ground planes. Layers 2 and 4 of the signal distribution board have conductor traces forming signal buses which will be described in further detail below.

The interconnection arrangement further comprises an input card 26. The input card 26 is double-sided, having conductor traces on each side. An input connector plug 14B is attached to one edge of the input card 26 and is engaged with the input connector receptacle 14A.

Figure 5:
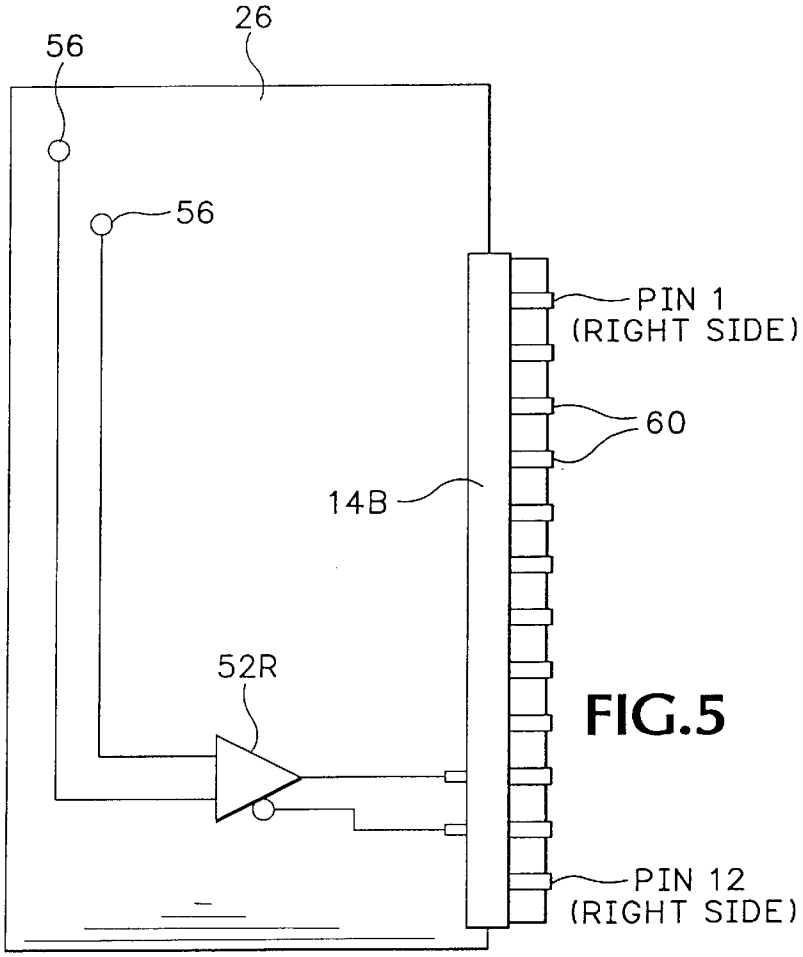
FIG. 5 is an elevation of the right side of the input card.
Figure 4:
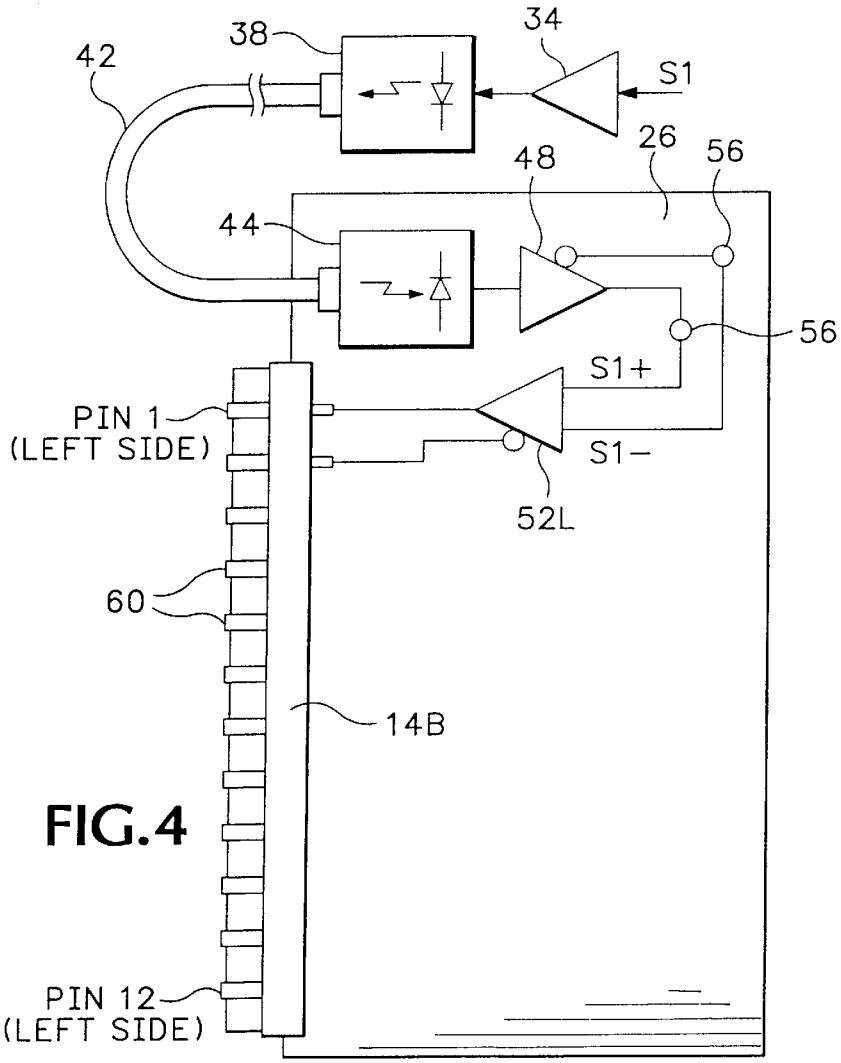
FIG. 4 is an elevation of the left side of an input card of the interconnection arrangement shown in FIG. 2.
Figure 6:
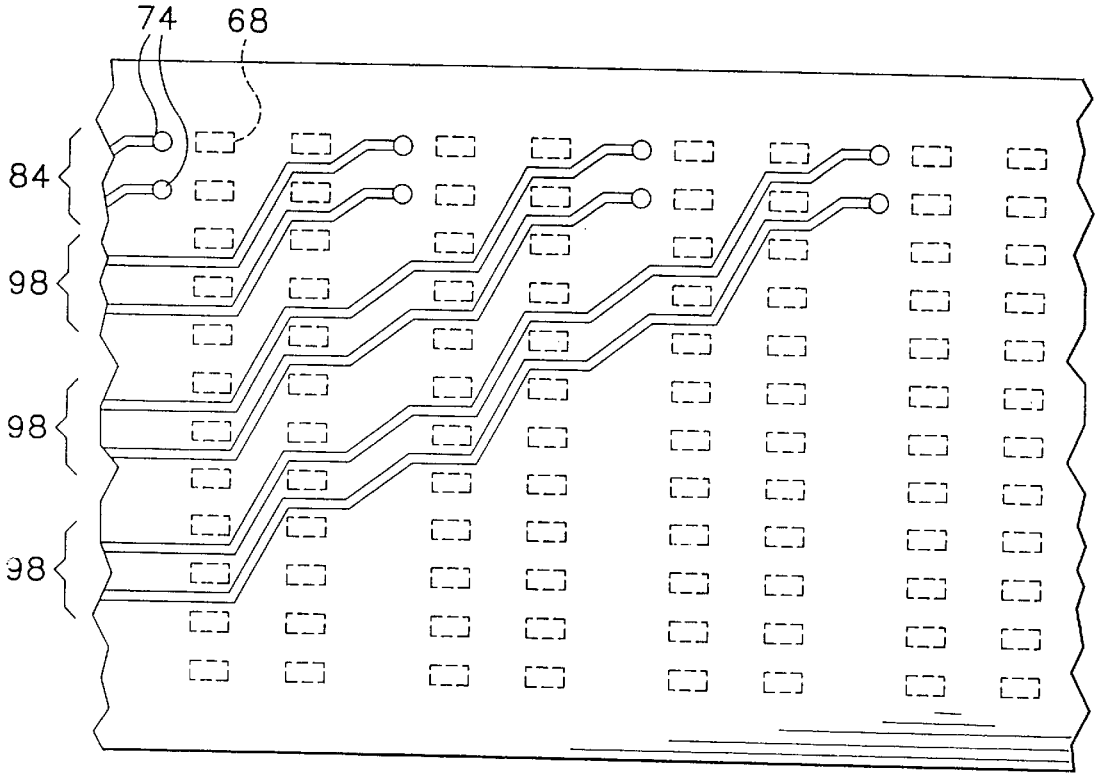
FIGS. 6 and 7 are schematic partial views of respective layers of the signal distribution board.

Referring to FIGS. 4 and 5, a buffer 34, which is not a part of the interconnection arrangement, supplies a single-ended electrical input signal S1 having two distinct logic levels and well-defined rising and falling edges to an optical driver 38 which generates a corresponding optical signal and supplies the optical signal over a fiber-optic cable 42 to an optical receiver 44 mounted on the input card 26. The optical receiver 44 provides a single-ended electrical output signal to a differential driver 48 which regenerates the electrical signal S1 in differential form S1+, S1−, each component having two distinct logic levels and well-defined rising and falling edges. Conductor traces on the input card 26 supply the differential signal S1+, S1− to two buffers 52L and 52R, on the left and right sides of the card 26 as viewed in FIG. 2. If one assumes that the optical receiver 44 is mounted on the left side of the card as shown in FIG. 4, the connections to the buffer 52R are through vias 56 in the card. Since the signal provided by the optical receiver 44 has been regenerated to well-defined logic levels by the driver 48, passing the signal through the vias 56 does not degrade the signal to an unacceptable degree.

The plug 14B, which is attached to the input card 26, has two rows of twelve pins 60 at each side. The pins of each row can usefully be referred to as pins 1–12, starting at the end of the plug 14B that is nearer the top of the card 26, as seen in FIGS. 4 and 5. The output terminals of the buffer 52L are connected by conductor traces on the left side of the card to pins 1 and 2 on the left side of the plug 14B and the output terminals of the buffer 52R are connected by conductor traces on the right side of the card to pins 10 and 11 on the right side of the plug 14B. Accordingly, the signal S1+, S1− is provided at pins 1 and 2 on the left side of the plug 14B and at pins 10 and 11 on the right side of the plug 14B. Pins 3, 6, 9 and 12 on each side of the plug are interconnected through the structure of the plug and at least one of these pins is connected to ground terminals of the functional components of the card 26, such as the buffers 52L and 52R. The other pins of the plug 14B are not used.

Figure 2:
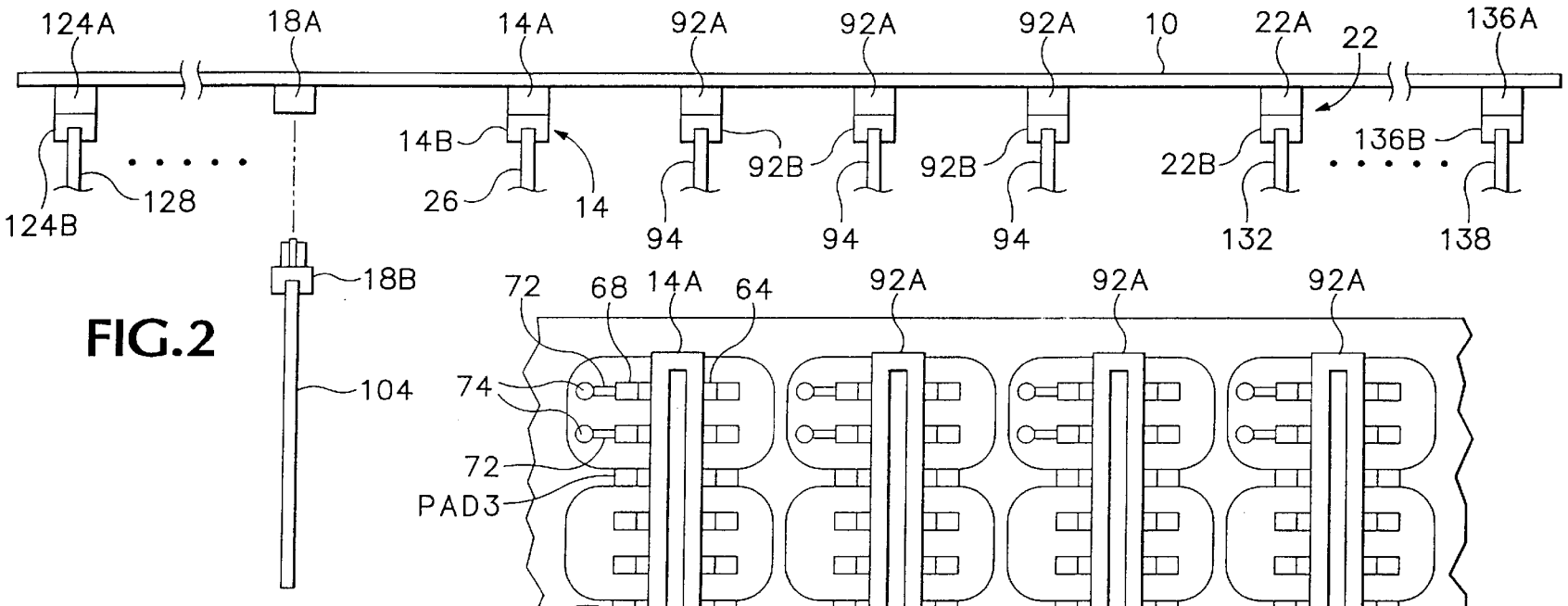
FIG. 2 is a top plan view of an interconnection arrangement in accordance with the present invention.
Figure 3:
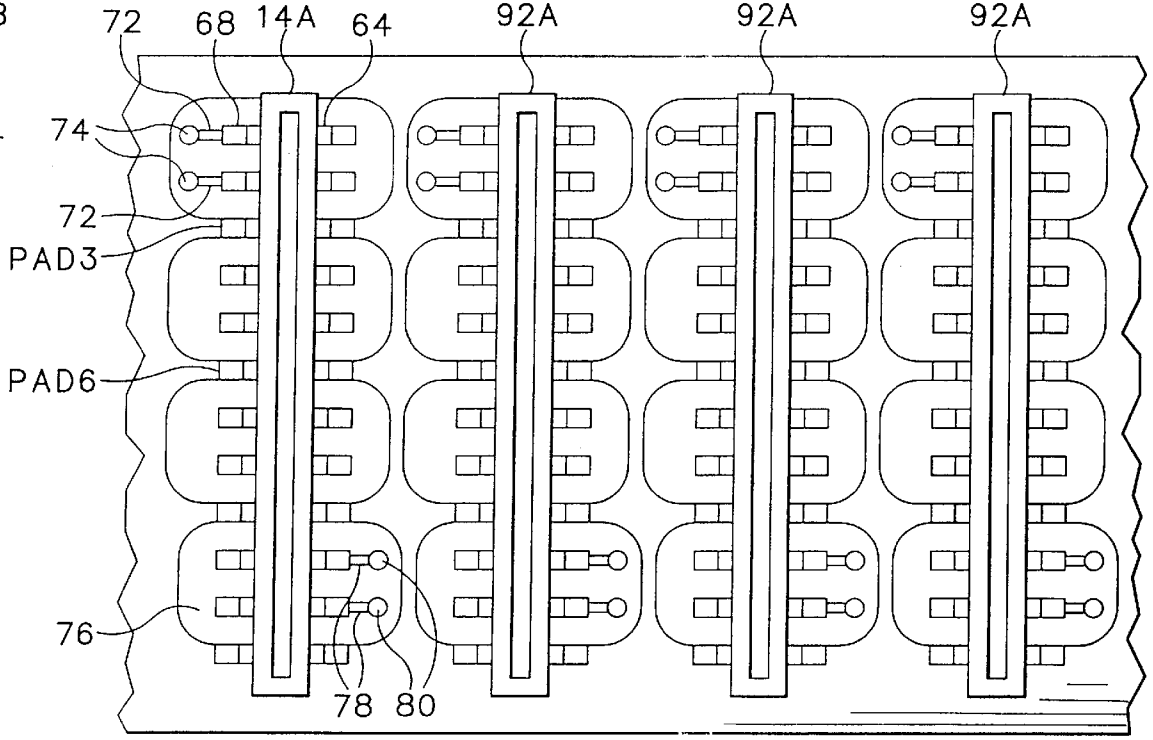
FIG. 3 is a partial elevation of the signal distribution board of the interconnection arrangement shown in FIG. 2.

Referring to FIGS. 2 and 3, the receptacle 14A, which is attached to the signal distribution board 10, has two rows of twelve pins (referred to as pins 1–12 respectively) at opposite respective sides of a slot which receives the plug 14B. When the plug 14B is fitted in the receptacle 14A, the pins of the plug 14B enter electrically conductive connection with respective pins of the receptacle 14A. The receptacle 14A is surface mounted and each pin of the receptacle is connected through the body of the receptacle to a tab 64 which is soldered to a pad 68 defined in layer 1 of the signal distribution board. The pads 68 to which pins 1–12 on a given side of the receptacle 14A are respectively connected, through the tabs 64, can usefully be referred to as pads 1–12.

Layer 1 of the signal distribution board is patterned so that the ground plane formed by layer 1 is connected to pads 3, 6, 9 and 12 on each side of the receptacle 14A and defines openings 76 surrounding the other pads. Layer 1 also includes short conductor traces 72 extending from pads 1 and 2 on the left side of the receptacle 14A to through vias 74 and conductor traces 78 extending from pads 10 and 11 on the right side of the receptacle to through vias 80.

Figure 7:
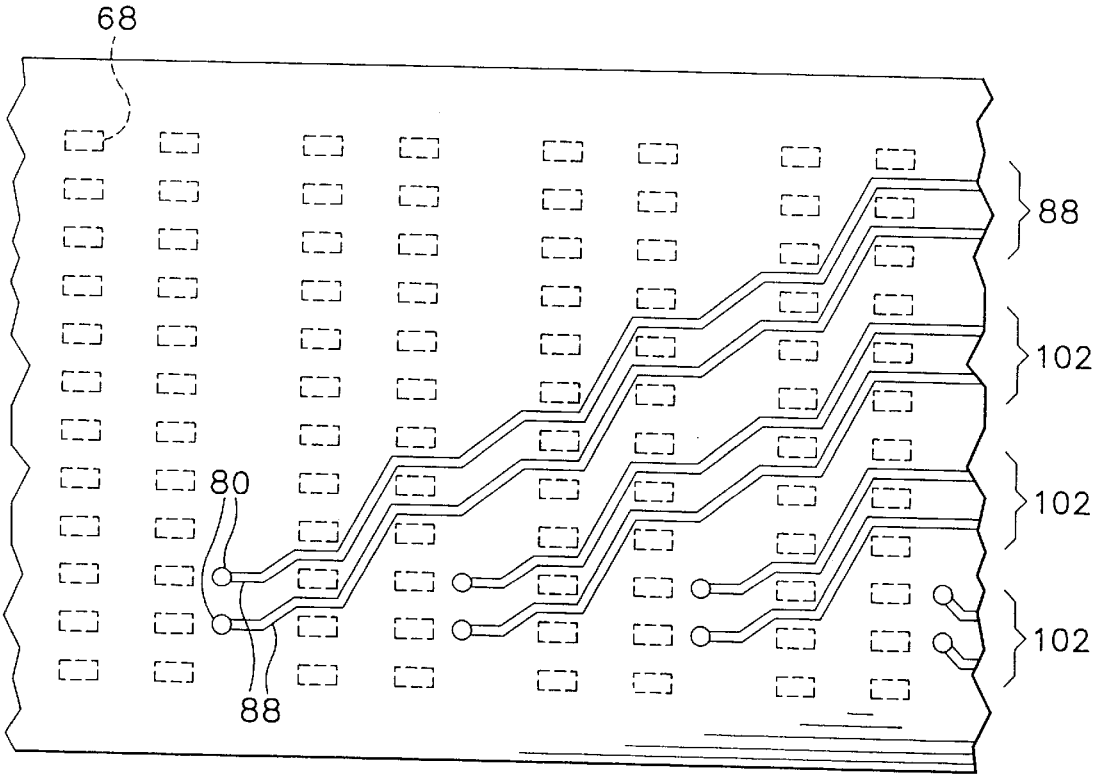

Layers 2 and 4 of the signal distribution board are signal layers. The vias 74 are connected to conductor traces forming a differential microstrip bus 84 in layer 2 (FIG. 6) whereas the vias 80 are connected to conductor traces forming a differential microstrip bus 88 in layer 4 (FIG. 7). The buses 84 and 88 extend from the vias 74 and 80 to the left and right respectively of the receptacle 14A. The differential signal S1+, S1− is provided at pins 1 and 2 on the left side of the plugs 14B and at pins 11 and 12 on the right side of the plug 14B. Since pins 1 and 2 on the left side of the plug are connected through the receptacle 14A and the vias 74 to the conductor traces forming the bus 84, the differential signal S1+, S1− is propagated on the microstrip bus 84. Similarly, the differential signal S1+, S1− is propagated on the differential microstrip bus 88. The differential microstrip buses 84 and 88 form a split center fed bus, the two parts of the split bus each carrying the signal provided by the optical receiver 44.

Three additional input connector receptacles 92A are attached to the signal distribution board adjacent the receptacle 14A, and additional input cards 94 have plugs 92B engaged with the connector receptacles 92A respectively. Each of the input cards 94 has an optical receiver, similar to the optical receiver 44, and the optical receivers of the three input cards 94 receive optical signals S2–S4 from respective optical drivers. The foregoing description of the card 26 is applicable to each of the input cards 94 also, and the foregoing description relating to the receptacle 14A is applicable to the input connector receptacles 92A also. Accordingly, the differential signals S2+, S2−−S4+, S4+ are provided at pins 1 and 2 on the left side of the plugs 92B respectively and at pins 10 and 11 on the right side of the plugs 92B respectively. Layer 2 of the signal distribution board contains three additional differential microstrip buses 98 connected to pins 1 and 2 of the input connector receptacles 92A respectively and propagating the signals S2+, S2−−S4+, S4− respectively and layer 4 contains three additional differential microstrip buses 102 connected to pins 10 and 11 of the input connector receptacles 92A respectively and propagating the signals S2+, S2−−S4+, S4− respectively.

Figure 9:
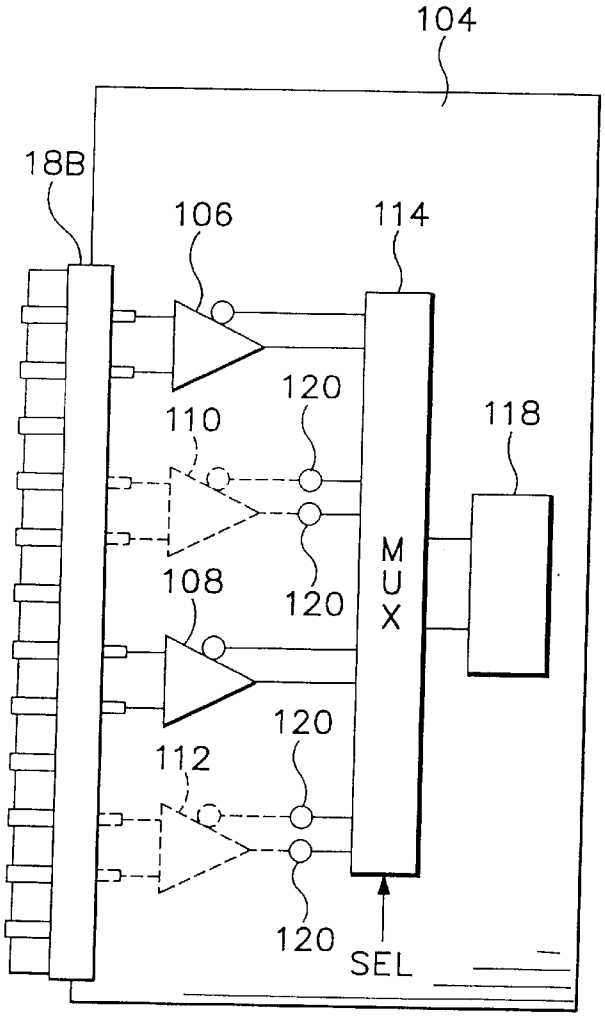
FIG. 9 is an elevation of the left side of a signal receiving card.
Figure 8:
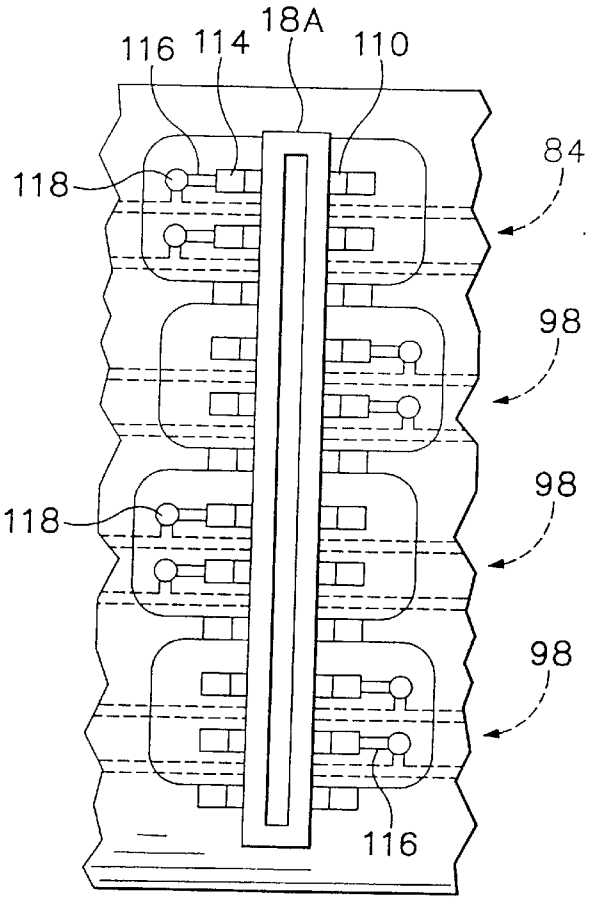
FIG. 8 is a partial elevation of the signal distribution board, showing a different detail from FIG. 3.

Referring to FIGS. 2, 8 and 9, the receiving connector receptacle 18A, which is mounted to the left of the input connector receptacles 14A and 92A, has a slot for receiving a plug 18B attached to one edge of a receiving card 104 and includes two rows of twelve pins (pins 1–12 respectively) at opposite respective sides of the slot. The receptacle 18A is surface mounted and each pin of the receptacle is connected through the body of the receptacle to a tab 110 which is soldered to a pad 114 formed in layer 1 of the signal distribution board. The pads 114 to which pins 1–12 on a given side of the receptacle 18A are respectively connected, through the tabs 110, can usefully be referred to as pads 1–12. Pads 1, 2, 7 and 8 on the left side of the receptacle 18A and pads 4, 5, 10 and 11 on the right side of the receptacle 18A are connected to short conductor traces 116 in layer 1 of the signal distribution board, and these short conductor traces are connected in turn through vias 118 to the conductor traces in layer 2 of the signal distribution board. Thus, pins 1 and 2 on the left side of the receptacle 18A are connected to the differential microstrip bus 84, which carries the signal S1+, S1−.

Similarly, pads 4 and 5 on the right side of the receptacle 18A are connected to the conductor traces forming the bus that propagates the signal S2+, S2− in layer 2, and pins 7 and 8 on the left side and 10 and 11 on the right side are connected to the conductor traces forming the buses that propagate the signals S3+, S3− and S4+, S4− respectively in layer 2. Pads 3, 6, 9 and 12 on each side of the receptacle 18A are connected to the ground plane of layer 1, and the other pads are isolated from conductor runs of the signal distribution board.

The plug 18B has two rows of pins which contact respective pins of the receiving connector receptacle 18A when the plug 18B is engaged with the receptacle 18A.

Referring to FIG. 9, the receiving card 104 is double-sided and carries a functional circuit which is divided between the two sides of the card. On the left side of the card 104 there is a differential receiver 106 having input terminals connected to pins 1 and 2 on the left side of the plug 18B and a differential receiver 108 having input terminals connected to pins 7 and 8 on the left side of the plug 18B. Similarly, on the right side of the receiving card there are two differential receivers 110 and 112 having input terminals connected to pins 4 and 5 and pins 10 and 11 respectively on the right side of the plug 18B. Accordingly, the differential signals S1+, S1−−S4+, S4− are supplied to the receivers 106–112 respectively. The differential receivers regenerate signal logic levels and supply differential signals to a multiplexer 114, which selects one of the differential signals in response to a select signal and supplies the selected differential signal to a receiving device 118. Since the multiplexer 114 is on the left side of the card 104, the outputs of the differential receivers 110 and 112 are supplied to the multiplexer 114 through vias 120. Since the differential signals have been regenerated to proper logic levels, the signals are not degraded to an unacceptable level by passing through the vias 120.

The signal path of the select signal is not relevant to the invention and therefore is not described herein. Further, the nature of the receiving device 118 is not relevant to the invention, nor is the signal path of the output of the receiving device.

At least one of pins 3, 6, 9 and 12 on each side of the plug 18B is connected to ground terminals of the functional components on that side of the card, such as the receiver 106 on the left side.

Seven additional receiving connector receptacles 124A are attached to the signal distribution board adjacent the receptacle 18A and additional receiving cards 128 have plugs 124B engaged with the receptacles 124A respectively. The foregoing description relating to the receiving connector 18 and the receiving card 104 applies equally to the receiving connectors 124 and to the respective cards 128.

The receiving connector receptacle 22A, which is mounted to the right of the input connector receptacles 14A and 92A, has a slot for receiving a plug 22B attached to one edge of a receiving card 132. The foregoing description relating to the receiving connector 18 and the receiving card 104 applies equally to the receiving connector 22 and the receiving card 132 except that the pins of the receptacle 22A are connected to the microstrip buses 88 and 102 in layer 4 of the signal distribution board. Further, seven additional receiving connector receptacles 136A are attached to the signal distribution board adjacent the receptacle 22A and additional receiving cards 138 have plugs 136B engaged with the receptacles 136A respectively. The foregoing description relating to the connector 22 and the receiving card 132 applies equally to the connectors 136 and the receiving cards 138.

Figure 1:
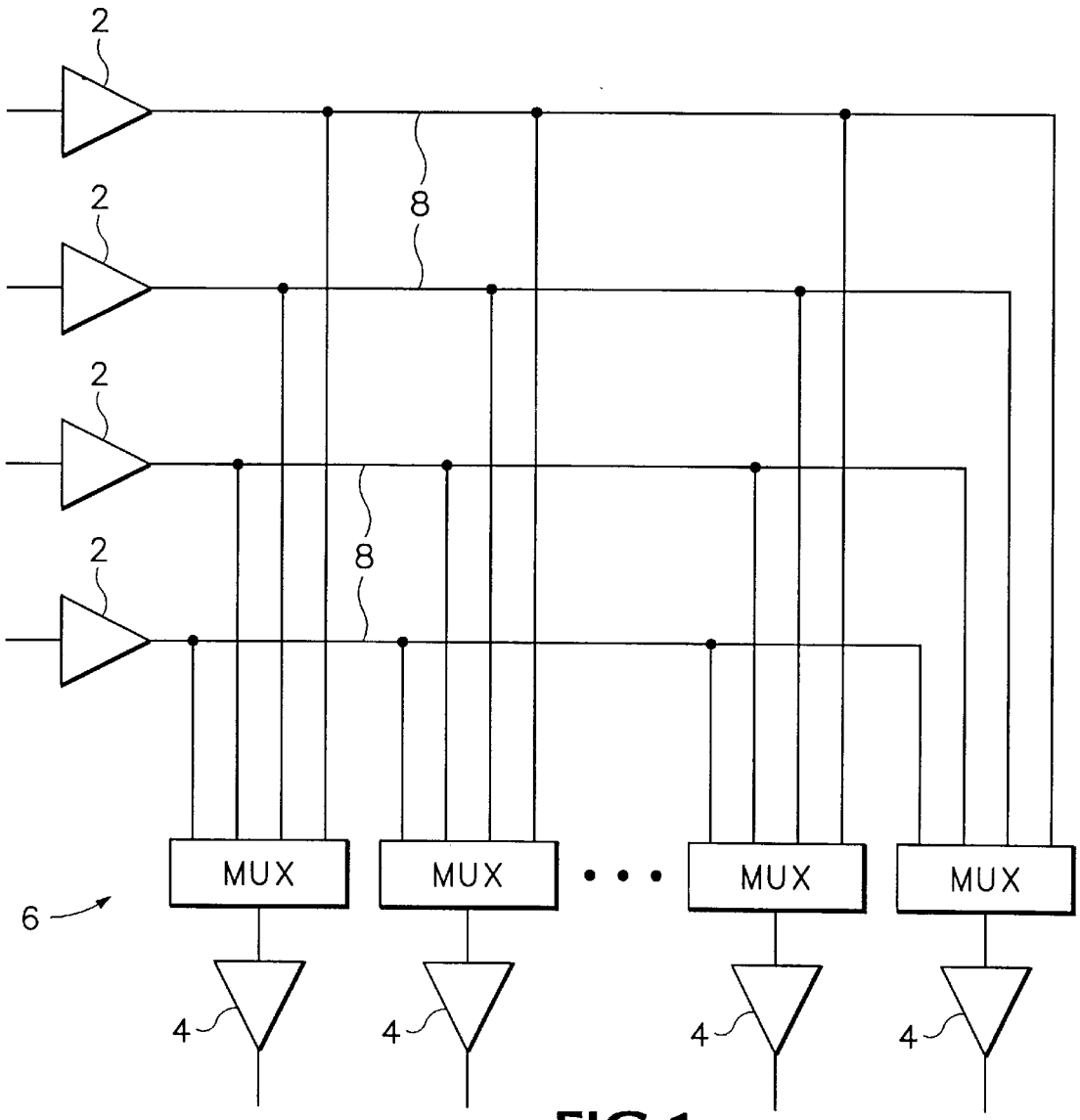
FIG.1 PRIOR ART
FIG. 1 is a schematic block diagram of an interconnection arrangement in accordance with the prior art.

The interconnection arrangement described with reference to FIGS. 2–9 provides the same flexibility as the arrangement shown schematically in FIG. 1. However, by dividing each bus into two segments, and sharing the receiving devices between the two bus segments, for a given number of receiving devices the maximum distance between the signal driver on the input card and a differential receiver on the most distant receiving card is reduced as compared with the arrangement shown in FIG. 1.

Over the interval of the signal distribution board occupied by the input connector receptacles 14A and 92A, the paths of the conductor traces of the differential microstrip buses are selected so as to maintain spacing between the buses and reduce interference between the signals. Interference between the different signals over the interval occupied by the input connector receptacles is also reduced by providing the traces that form the left part of the bus in layer 2 and the traces that form the right part of the bus in layer 4. Depending on the pattern of the conductor traces, it may be desirable to provide ground vias in the signal distribution board for shielding conductor traces of one split bus from the conductor traces of another split bus.

In the arrangement described above, the pin connections of each input connector receptacle are the same, and therefore the input cards are interchangeable. Similarly, the receiving cards are interchangeable.

The implementation described with reference to FIG. 2–9 may be extended to more complex structures. For example, the input card 26 may be provided with circuits for generating one or more additional differential signals, and an additional differential signal could be provided at, for example, pins 4 and 5 on the left side of the receptacle 14A and pins 7 and 8 on the right side of the receptacle 14A. In this case, there would be eight split center fed buses serving the two sets of receiving card receptacles. Further, in the more complex arrangement, the differential microstrip buses feeding the receptacles 18A and 124A could be shared between layers 2 and 4, and similarly the differential microstrip buses feeding the receptacles 22A and 136A could be shared, which would allow wider signal traces and improved impedance control.

The vias 74, 80 and 118 in the signal distribution board are preferably through vias, rather than blind or buried vias, for symmetry.

Preferably, the connectors are of the type sold by AMP Incorporated under the designation MICTOR. This type of connector provides a high linear density of signal lines and requires only a small insertion force.

It will be appreciated that the invention is not restricted to the particular embodiment that has been described, and that variations may be made therein without departing from the scope of the invention as defined in the appended claims and equivalents thereof.

I claim:

1. An interconnection arrangement comprising:

an input card, a signal distribution board having first and second opposite main faces, first and second sets of signal receiving cards, a plurality of connectors, the plurality of connectors being composed of an input connector, a first set of distribution connectors and a second set of distribution connectors, each of said connectors having first and second releasably engageable parts with the first part of the input connector being attached to the signal distribution board at the first main face thereof, the first part of each connector of the first set of distribution connectors being attached to the signal distribution board at the first main face thereof and spaced from the first part of the input connector in a first direction, and the first part of each connector of the second set of distribution connectors being attached to the signal distribution board at the first main face thereof and spaced from the first part of the input connector in a second direction, which is opposite said first direction, the second part of the input connector being attached to the input card, the second parts of the first set of distribution connectors being attached to the first set of signal receiving cards respectively, and the second parts of the second set of distribution connectors being attached to the second set of signal receiving cards respectively, a bus driver circuit mounted on the input card, the bus driver circuit having a signal input terminal for receiving an input signal to be distributed and including first and second bus drivers each having an input connected to said signal input terminal and having separate respective outputs connected to first and second pins respectively of the second part of the input connector, a first signal distribution bus on the signal distribution board extending from a first pin of the first part of the input connector in said first direction and connected to pins of the first parts of the first set of distribution connectors, a second signal distribution bus on the signal distribution board extending from a second pin of the first part of the input connector in said second direction and connected to pins of the first parts of the second set of distribution connectors, and wherein the first and second pins of the first part of the input connector are connected to the first and second pins respectively of the second part of the input connector when the first and second parts of the input connector are engaged.

2. An interconnection arrangement according to claim 1, wherein the input card has first and second opposite sides and the first and second bus drivers are mounted on the first and second sides respectively of the input card, the first side being oriented toward the first set of signal receiving cards and the second side being oriented toward the second set of signal receiving cards.

3. An interconnection arrangement according to claim 1, wherein the first and second pins of the second part of the input connector are at the first and second sides respectively of the input card.

4. An interconnection arrangement according to claim 1, wherein each bus driver has a pair of differential outputs, the outputs of the first bus driver being connected to first and third pins respectively of the second part of the input connector and the outputs of the second bus driver being connected to second and fourth pins respectively of the second part of the input connector, and wherein the first signal distribution bus is a differential bus having conductors extending from the first and a third pin of the first part of the input connector in said first direction and the second signal distribution bus is a differential bus having conductors extending from the second pin and a fourth pin of the first part of the input connector, and the third and fourth pins of the first part of the input connector are connected to the third and fourth pins respectively of the second part of the input connector when the first and second parts of the input connector are engaged.

5. An interconnection arrangement according to claim 4, wherein the signal distribution board has at least first and second conductor layers and the first signal distribution bus is formed by conductor runs of the first layer and the second signal distribution bus is formed by conductor runs of the second layer.

6. An interconnection arrangement according to claim 5, wherein the signal distribution board has third, fourth and fifth conductor layers, the third layer is between the first and second layers, the fourth layer is between the first and second layers and the second layer is between the third and fifth layers, and the third, fourth and fifth layers are ground layers.

7. An interconnection arrangement comprising:

first and second input cards, a signal distribution board having first and second opposite main faces, first and second sets of signal receiving cards, a plurality of connectors, the plurality of connectors being composed of first and second input connectors, a first set of distribution connectors and a second set of distribution connectors, each of said connectors having first and second releasably engageable parts with the first part of each input connector being attached to the signal distribution board at the first main face thereof, the first part of each connector of the first set of distribution connectors being attached to the signal distribution board at the first main face thereof and spaced from the first parts of the input connectors in a first direction, and the first part of each connector of the second set of distribution connectors being attached to the signal distribution board at the first main face thereof and spaced from the first parts of the input connectors in a second direction, which is opposite said first direction, the second parts of the first and second input connectors being attached to the first and second input cards respectively, the second parts of the first set of distribution connectors being attached to the first set of signal receiving cards respectively, and the second parts of the second set of distribution connectors being attached to the second set of signal receiving cards respectively, and first and second bus driver circuits mounted on the first and second input cards respectively, the bus driver circuit mounted on each input card having a signal input terminal for receiving an input signal to be distributed and including first and second bus drivers each having an input connected to said signal input terminal and having separate respective outputs connected to first and second pins respectively of the second part of the input connector attached to the input card, wherein the first and second pins of the first part of the first input connector are connected to the first and second pins respectively of the second part of the first input connector when the first and second parts of the first input connector are engaged and the first and second pins of the first part of the second input connector are connected to the first and second pins respectively of the second part of the second input connector when the first and second parts of the second input connector are engaged.

8. An interconnection arrangement according to claim 7, further comprising a first signal distribution bus on the signal distribution board extending from a first pin of the first part of the first input connector in said first direction and connected to pins of the first parts of the first set of distribution connectors, a second signal distribution bus on the signal distribution board extending from a second pin of the first part of the first input connector in said second direction and connected to pins of the first parts of the second set of distribution connectors, a third signal distribution bus on the signal distribution board extending from a first pin of the first part of the second input connector in said first direction and connected to pins of the first parts of the first set of distribution connectors, and a fourth signal distribution bus on the signal distribution board extending from a second pin of the first part of the second input connector in said second direction and connected to pins of the first parts of the second set of distribution connectors.

9. An interconnection arrangement according to claim 8, wherein the first part of each connector of the first set of distribution connectors has first and second pins connected to the first and third buses respectively, a signal receiving circuit is mounted on each signal receiving card, the signal receiving circuit having at least two signal input terminals connected to first and second pins respectively of the second part of the distribution connector to which the signal receiving card is attached, and the first and second pins of the first part of the distribution connector are connected to the first and second pins of the second part of the distribution connector when the first and second parts of the distribution connector are engaged.

10. An interconnection arrangement according to claim 8, wherein the signal distribution board has at least two conductor layers and the first and third signal distribution buses are formed by conductor runs of a first layer of the signal distribution board and the second and fourth signal distribution buses are formed by conductor runs of the second layer.

11. An interconnection arrangement according to claim 10, wherein the signal distribution board has third, fourth and fifth conductor layers, the third layer is between the first and second layers, the fourth layer is between the first and second layers and the second layer is between the third and fifth layers, and the third, fourth and fifth layers are ground layers.

12. An interconnection arrangement comprising:

an input card, a signal distribution board having first and second opposite main faces, an input connector having first and second releasably engageable parts with the first part of the input connector attached to the signal distribution board at the first main face thereof and the second part of the input connector attached to the input card, a bus driver circuit mounted on the input card, the bus driver circuit having a signal input terminal for receiving an input signal to be distributed and including first and second bus drivers each having an input connected to said signal input terminal and having separate respective outputs connected to first and second pins respectively of the second part of the input connector, a first signal distribution bus on the signal distribution board extending from a first pin of the first part of the input connector in a first direction, and a second signal distribution bus on the signal distribution board extending from a second pin of the first part of the input connector in a second direction, opposite said first direction, and wherein the first and second pins of the first part of the input connector are connected to the first and second pins respectively of the second part of the input connector when the first and second parts of the input connector are engaged.

* * * * *